US005528479A

United States Patent [19]

Chen

[11] Patent Number: 5,528,479

[45] Date of Patent: Jun. 18, 1996

[54] MULTIPLY-POSITIONED MOUNTING BLOCK OF LIGHTING FIXTURE

[76] Inventor: Duncan Chen, c/o Hung Hsing Patent Service Center, P.O. Box 55-1670, Taipei, Taiwan

[21] Appl. No.: 335,483

[22] Filed: Nov. 7, 1994

[51] Int. Cl.[6] ..... F21S 1/12

[52] U.S. Cl. ..... 362/410; 362/257; 362/351; 362/442; 248/163.1; 248/529

[58] Field of Search ..... 362/382, 388, 362/410, 413, 414, 431, 435, 441, 442, 449, 257, 351; 248/163.1, 165, 176, 188.7, 529

[56] References Cited

U.S. PATENT DOCUMENTS

| | | | |
|---|---|---|---|
| 517,211 | 3/1894 | Clarke | 248/163.1 |
| 1,298,380 | 3/1919 | Owen | 248/529 |
| 1,997,870 | 4/1935 | Merrill | 248/529 |
| 2,748,262 | 5/1956 | McCrea | 362/413 |
| 4,562,521 | 12/1985 | Noguchi | 362/414 |
| 5,084,810 | 1/1992 | Huang | 362/414 |

FOREIGN PATENT DOCUMENTS

| | | | |
|---|---|---|---|
| 1387672 | 12/1964 | France | 362/413 |

*Primary Examiner*—Denise L. Gromada
*Assistant Examiner*—Alan B. Cariaso

[57] ABSTRACT

A mounting block of a lighting fixture includes a plurality of tilting screw holes inclinedly formed in the block for detachably mounting a plurality of supporting leg members in a bottom portion of the block, and a central hole vertically formed through the block for detachably securing a central post of a lamp socket or a shade in the central hole, whereby upon positioning of the mounting block on a lower position of a lighting fixture, the mounting block will serve as a supporting base of the lighting fixture; and upon positioning of the mounting block on a middle portion of a lighting fixture, the mounting block will serve as a lamp holder for directly securing a lamp socket and a shade on the block; and upon positioning of the mounting block on an apex of a lighting fixture, a fantastic pyramid structure of lighting fixture will be formed by suspending the shade and lamp socket on the supporting leg members protruding inclinedly downwardly from the mounting block.

1 Claim, 5 Drawing Sheets

MULTIPLY-POSITIONED MOUNTING BLOCK OF LIGHTING FIXTURE

BACKGROUND OF THE INVENTION

A conventional lighting fixture such as for use in a table lamp, floor lamp or mini lamp may require a heavy supporting base for mounting a support post on the supporting base to secure the lamp and shade on the support post, thereby causing handling inconvenience and increasing production cost.

Since the supporting base and the other mounting devices of the conventional lighting fixture are generally made as fixed type, not detachable knock-down device, it is therefore not suitable for providing a do-it-yourself (D-I-Y) product for satisfying the requirement of certain people.

The present inventor has found this phenomena and invented a mounting block for detachably mounting the elements of a lighting fixture in a convenient way and for diversified design choices, especially suitable for "do-it-yourself" lamp products.

SUMMARY OF THE INVENTION

The object of the present invention is to provide a mounting block for forming a lighting fixture including a plurality of tilting screw holes inclinedly formed in the block for detachably mounting a plurality of supporting leg members in a bottom portion of the block, and a central hole vertically formed through the block for detachably securing a central post of a lamp socket or a shade in the central hole, whereby upon positioning of the mounting block on a lower position of a lighting fixture, the mounting block will serve as a supporting base of the lighting fixture; and upon positioning of the mounting block on a middle portion of a lighting fixture, the mounting block will serve as a lamp holder for directly securing a lamp socket and a shade on the block; and upon positioning of the mounting block on an apex of a lighting fixture, a fantastic pyramid structure of lighting fixture will be formed by suspending the shade and lamp socket on the supporting leg members protruding inclinedly downwardly from the mounting block.

DETAILED DESCRIPTION

Figure 1:
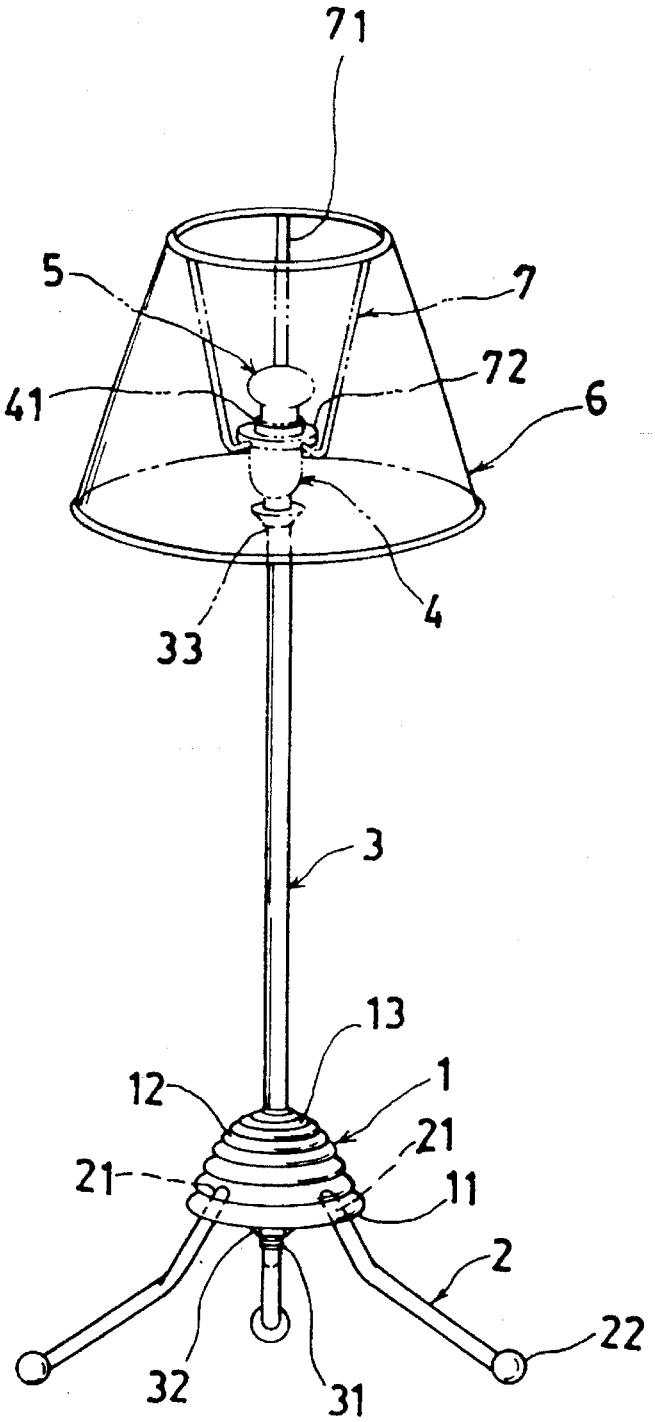
FIG. 1 is a perspective view of the present invention when the mounting block is positioned at a lower portion of the lighting fixture for serving as a supporting base.
Figure 2:
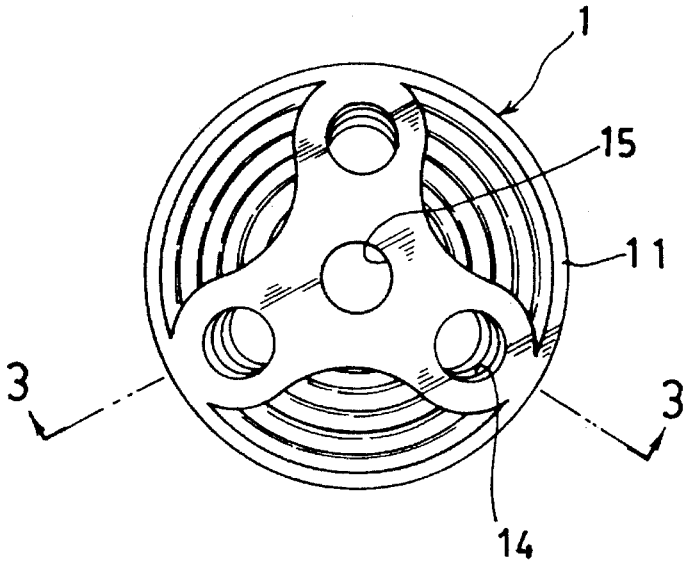
FIG. 2 is a bottom view of the mounting block of the present invention.
Figure 3:
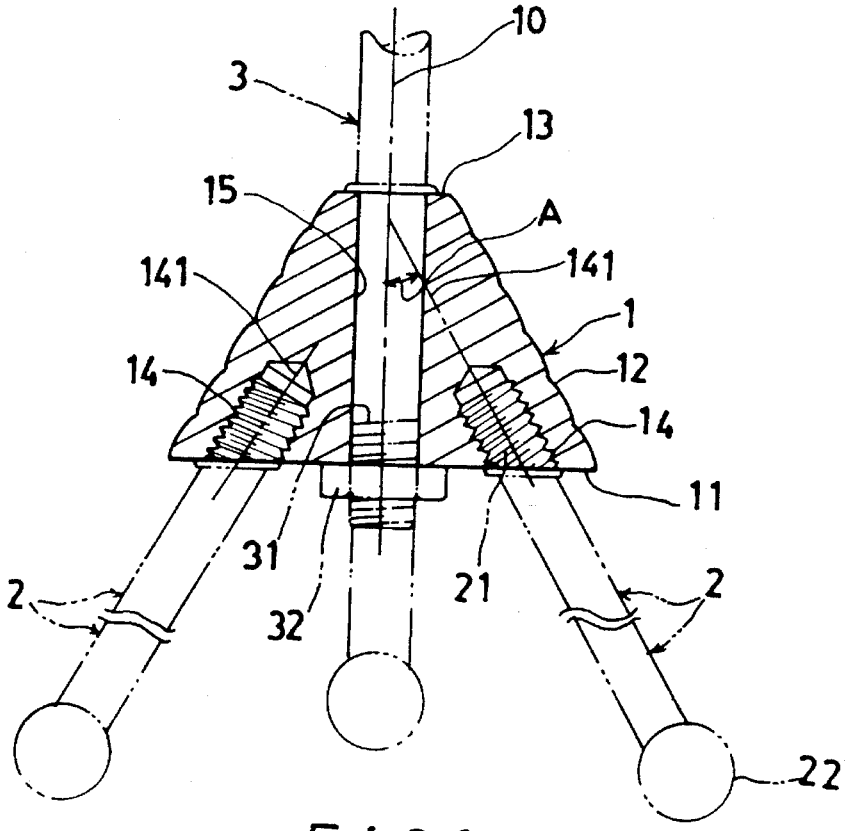
FIG. 3 is a sectional drawing of the mounting block when viewed from 3—3 direction of FIG. 2.

As shown in FIGS. 1–3, the mounting block 1 of the present invention is generally shaped as a truncated cone having a bottom surface 11, a conical surface 12 tapered upwardly from the bottom surface 11, a top surface 13 horizontally formed on a top of the conical surface 12, a plurality of tilting screw holes 14 radially inclinedly formed in a bottom portion of the mounting block 1 each tilting screw hole 14 defining a screw-hole axis 141 at a center of each tilting screw hole 14 and having female threads helically formed in each tilting screw hole 14, and a central hole 15 vertically formed through the mounting block 1 and defining a vertical axis 10 for forming an acute angle A with each screw-hole axis 141, with each tilting screw hole 14 inclined downwardly radially from the bottom surface 11 of the mounting block 1.

Each tilting screw hole 14 is engaged with an upper end portion 21 formed with male threads thereon of each supporting leg member 2 for detachably mounting each supporting leg member 2 in a bottom portion of the mounting block 1. Each leg member 2 may have a frictional pad 22 formed on a lower end of the leg member 2. Such a pad 22 may be spherical shaped as shown in FIG. 1 for stably standing on a floor or surface.

A central post 3 may be installed on the mounting block 1 as shown in FIG. 1 by inserting a lower end portion 31 of the post 3, preferably made with male threads on the lower end portion 31 of the post 3, through the central hole 15 of the mounting block 1 to be retained on the bottom surface 11 of the block 1 by engaging a nut 32 having female threads formed in the nut 32 with the lower end portion 31 of the post 3 for detachably mounting the central post 3 on the block 1, whereby the mounting block 1 will serve as a "supporting base" for a lighting fixture as shown in FIG. 1.

As shown in FIG. 1, a lamp socket 4 for fixing a lamp or bulb 5 in the lamp socket 4 is secured on an upper end portion 33 of the central post 3. A lamp shade 6 is secured to the lamp socket 4 by means of a shade bracket 7. The shade bracket or spider 7 includes a plurality of branched arm members 71 (such as triturated arm members) secured with an upper periphery of the shade 6 and a central collar 72 radially linked with the arm members 71 and retained on the lamp socket 4 as detachably fastened by a retainer 41, thereby detachably mounting the shade 6, the lamp 5, and the lamp socket 4 on the upper end portion 33 of the central post 3 which is supported by a "base" formed by the mounting block 1 and the leg members 2.

Figure 4:
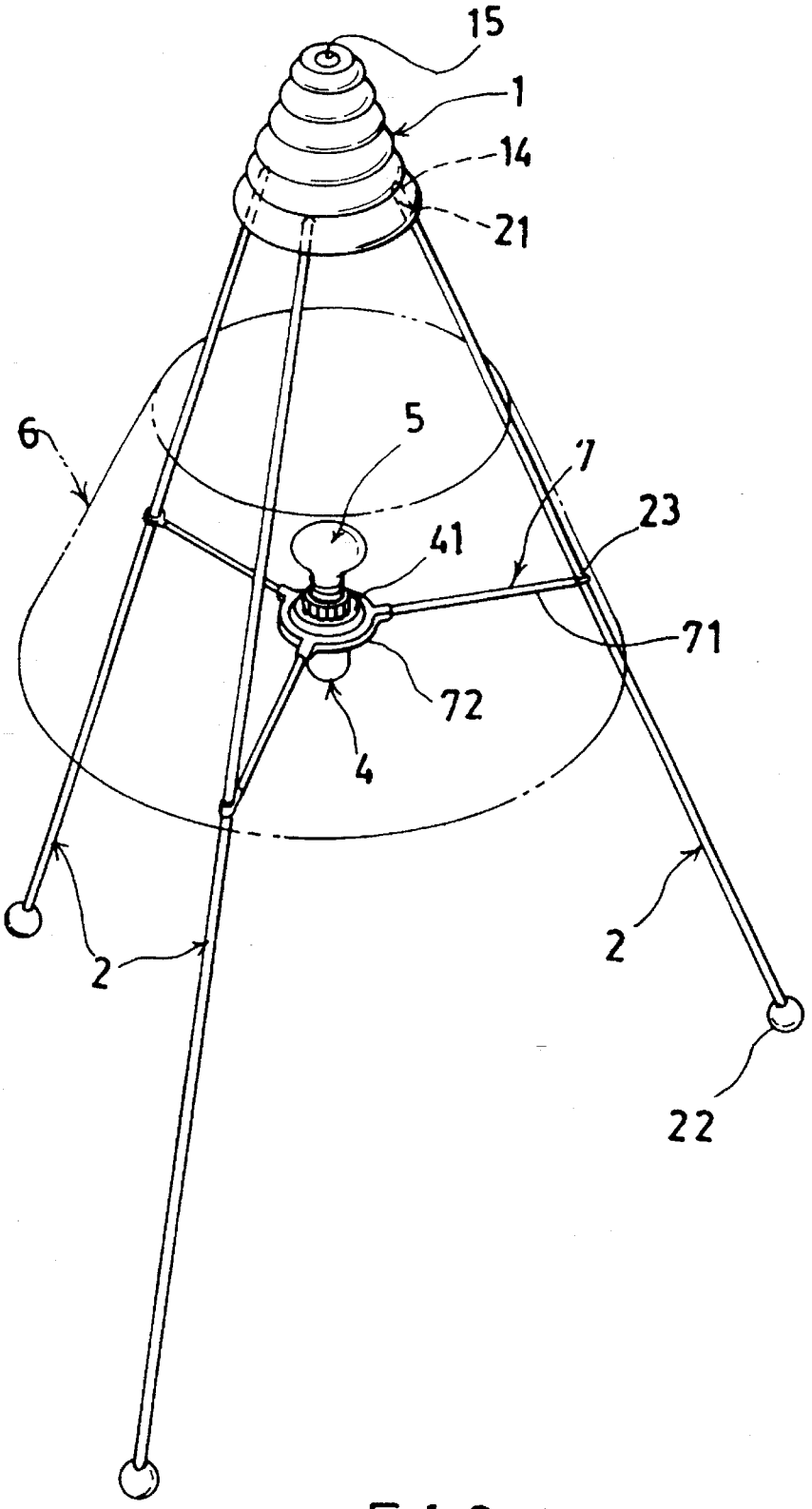
FIG. 4 shows another use of the mounting block of the present invention.

As shown in FIG. 4, the lamp socket 4 having the lamp 5 secured thereon by retainer 41 is suspended on the central collar 72 of the shade bracket 7 having the arm members 71 radially secured to the central collar 72 with each arm member 71 outwardly secured to an intermediate portion 23 of each supporting leg member 2. In this situation, the three supporting leg members 2 will serve as a tripod and are protruded inclinedly downwardly from the mounting block 1 which is positioned at an apex of a "pyramid" constructed by the three supporting leg members 2. The shade 6 of cone shape may be jacketed on the leg members 2 of the pyramid-shaped lighting fixture.

Each tilting screw hole 14 is engageable with each upper end portion 21 of each supporting leg member 2. In this situation, the mounting block 1 of the present invention will act like a pyramid apex for securing the elements of the lighting fixture thereunder, thereby forming a fantastic ornamental design of lighting fixture. The central hole 15 is not used in this circumstance.

Figure 5:
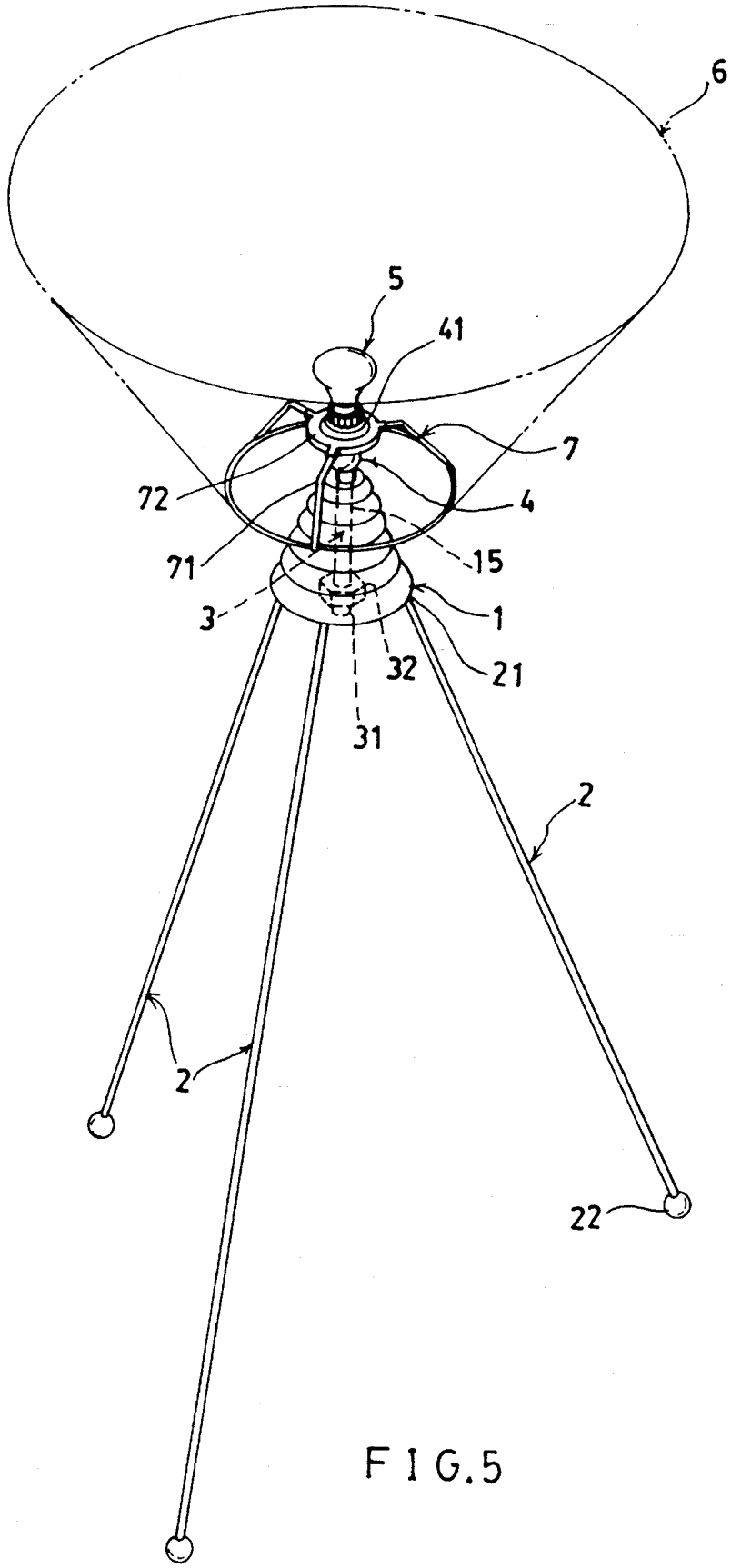
FIG. 5 shows still another use of the mounting block of the present invention.
Figure 6:
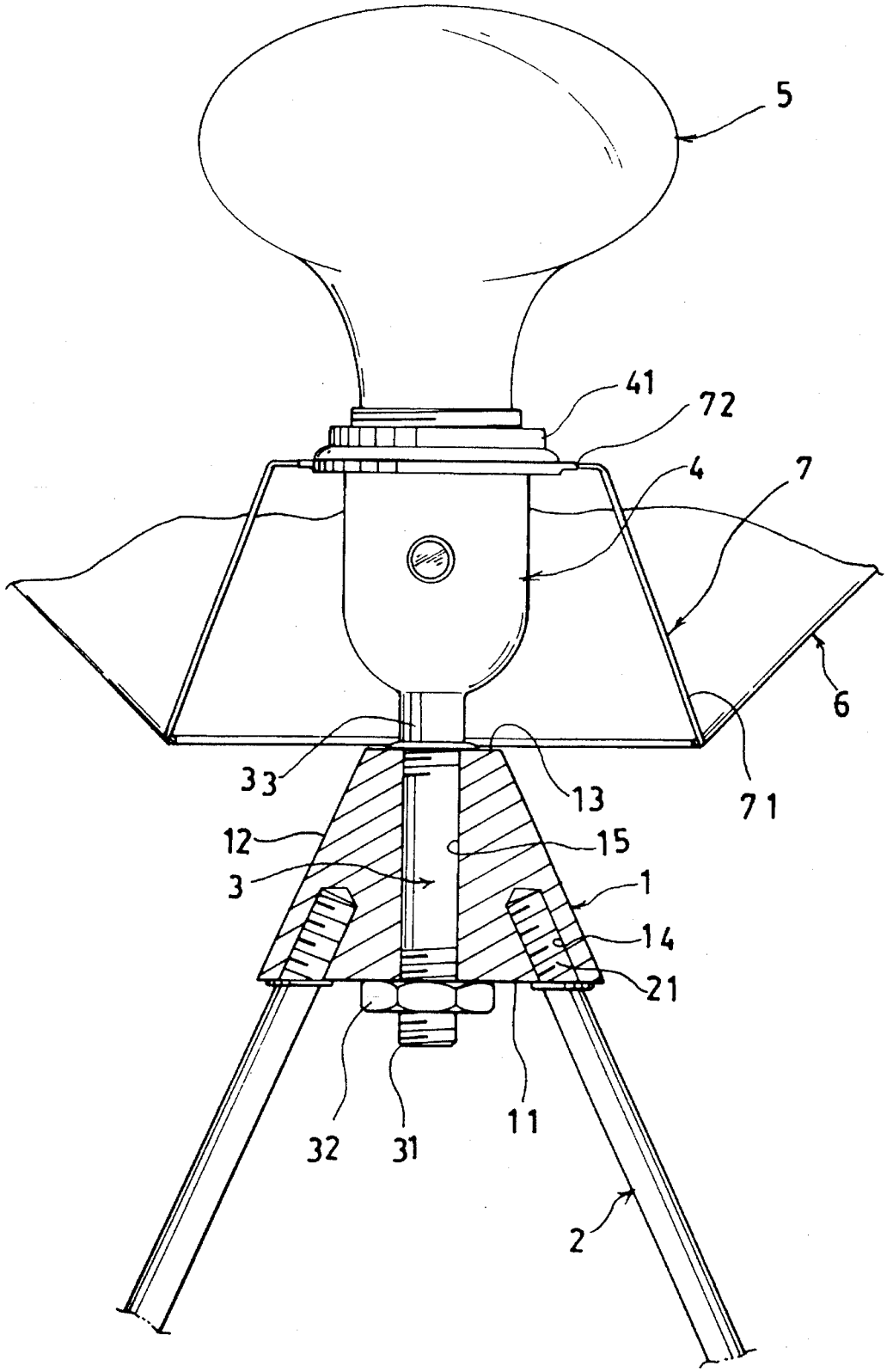
FIG. 6 is a partial sectional drawing of the mounting block as shown in FIG. 5.

As shown in FIGS. 5 and 6, the plural supporting leg members 2 are radially inclinedly mounting on the bottom surface 11 of the mounting block 1, while the shade 6 and the lamp socket 4 are mounted on the central post 3 and rested upon the top surface 13 of the mounting block 1. The central post 3 is shortened in comparison with that of FIG.

1, with the block 1 serving as a holder for holding the lamp socket 4 and the shade 6 thereon.

The upper end portion 33 of the "short" central post 3 is connected with the lamp socket 4. The collar 72 of the shade bracket (or spider) 7 is retained on the lamp socket 4 by the retainer 41 and the trifurcated arm members 71 are radially secured to a lower periphery of the shade 6 diverging upwardly outwardly as shown in FIG. 5 for projecting light beams of the lamp 5 upwardly.

The present invention may be modified without departing from the spirit and scope of this invention.

The mounting block 1 may be formed by integral molding or by a casting process such as made of a metal casting.

The tilting angle A of each tilting screw hole 14 is not limited in this invention, depending upon the design choices and standing stability of the lighting fixture.

The block 1 may serve as a base (FIG. 1), a holder (FIG. 5) or a "hanger" (FIG. 4) for mounting the elements of a lighting fixture thereon in a simpler and cheaper way, convenient for handling and assembly, especially suitable for D-I-Y products.

I claim:

1. A mounting block of a lighting fixture generally shaped as a truncated cone having a bottom surface, a conical surface tapered upwardly from said bottom surface, a top surface horizontally formed on a top of the conical surface, a plurality of tilting screw holes radially inclinedly formed in a bottom portion of the mounting block adapted for detachably mounting a plurality of supporting leg members in said tilting screw holes, and a central hole vertically formed through the mounting block; said mounting block positioned at a pyramid apex of said lighting fixture having three said supporting leg members protruding radially downwardly from said bottom surface of said mounting block to be rested on a surface, with a lamp socket and a shade suspended on an intermediate portion of each said supporting leg member.

* * * * *